United States Patent [19]

Katsuno

[11] Patent Number: 4,978,240

[45] Date of Patent: Dec. 18, 1990

[54] INK RIBBON CARTRIDGE FOR PRINTING APPARATUS

[75] Inventor: Hiroshi Katsuno, Kanagawa, Japan

[73] Assignee: Sony Corporation, Tokyo, Japan

[21] Appl. No.: 401,231

[22] Filed: Aug. 31, 1989

[30] Foreign Application Priority Data

Sep. 9, 1988 [JP] Japan ..... 63-226187

[51] Int. Cl.[5] ..... B41J 33/52

[52] U.S. Cl. ..... 400/224.2; 101/336; 400/246; 400/234

[58] Field of Search ..... 101/336; 226/195; 400/246, 224.2, 208, 234; 242/71, 71.1, 71.2, 67.3 R, 75.4, 198–200

[56] References Cited

U.S. PATENT DOCUMENTS

| | | | |
|---|---|---|---|
| 4,160,605 | 7/1979 | Neubaum | 242/71.2 X |
| 4,630,915 | 12/1986 | Whiteside et al. | 242/71.2 X |
| 4,764,041 | 8/1988 | Bierhoff | 400/234 X |
| 4,800,812 | 1/1989 | Lin | 400/613 X |

FOREIGN PATENT DOCUMENTS

| | | | |
|---|---|---|---|
| 1589350 | 5/1981 | Fed. Rep. of Germany . | |
| 2366131 | 4/1978 | France . | |
| 2504858 | 2/1981 | France | 400/234 |
| 56-27383 | 3/1981 | Japan | 400/208 |
| 61-222772 | 3/1986 | Japan . | |
| 61-167597 | 7/1986 | Japan | 400/208 |

*Primary Examiner*—Edgar S. Burr
*Assistant Examiner*—Motilal P. Patel
*Attorney, Agent, or Firm*—Vorys, Sater, Seymour & Pease

[57] ABSTRACT

An ink ribbon cartridge for a printing apparatus, in which two reels for the supply and take-up of a ink ribbon are rotatably mounted, incorporates a cartridge body and cover in which support sections for retaining the ends of the reels are provided. At an end of the cartridge, leaf springs are included which apply a constant frictional force to the reel hubs to prevent unwanted rotation of the reels. Therefore unwanted slackening of the ribbon is prevented, whether or not the printing apparatus is engaged in a printing operation.

14 Claims, 7 Drawing Sheets

INK RIBBON CARTRIDGE FOR PRINTING APPARATUS

BACKGROUND OF THE INVENTION

1. Field of the Invention

The present invention relates to an ink ribbon cartridge which is optimally adapted for use in printing apparatus, and particularly to a cartridge which is continuously capable of preventing the ink ribbon wound on a pair of reels accommodated in the cartridge from slackening.

2. Description of the Prior Art

Recently, there have been proposed and developed various color printing apparatus which include a ribbon of colored ink consisting of a series of three coloured segments, such as a yellow, a fuchsin (magenta) acting as a red, and a cyanogen acting as a blue. As is well known, this ink ribbon is wound on a pair of reels, one being a supply reel and the other a take-up reel.

One such conventional ribbon cartridge for color printing apparatus will be described with reference to FIGS. 1 to 3. An ink ribbon cartridge 1 includes a cartridge body 2 formed of synthetic resin and a cartridge cover 3 also of synthetic resin. In general, the cartridge body 2 and the cartridge cover 3 are joined by ultrasonic welding. A pair of essentially cylindrical supply and take-up reels 8 and 9 are accommodated in an internal space defined between the cartridge body 2 and the cartridge cover 3. The cartridge body 2 has front and rear walls 2*a* and 2*b* opposing each other. The front wall 2*a* is formed with a pair of support sections 4 at both ends thereof for supporting one end of each of the reels 8 and 9. Each support section 4 has a semi-circular cut-out for receiving the outer peripheral surface of one end of a reel. Similarly, the rear wall 2*b* is formed with a pair of support sections 5 at both ends thereof for supporting the other ends of each of the reels 8 and 9. Each support section 5 has a projection for receiving the outer peripheral surface of the other end of a reel. The cartridge body 2 includes a pair of substantially semi-cylindrical storage sections 2*c* and 2*d* between the two pairs of support sections 4 and 5 for rotatably containing the two reels 8 and 9. The cartridge body 2 also includes an essentially rectangular opening 2*e* between the two storage sections 2*c* and 2*d*.

The cartridge cover 3 has front and rear walls 3*a* and 3*b* opposing each other. The front wall 3*a* is provided with a pair of support sections 6 at both ends thereof for supporting one end of each of the reels 8 and 9. Each support section 6 has a semi-circular cut-out which is associated with the semi-circular cut-out of the support section 4 to form a circular support portion serving to rotatably support one end of the reel. On the other hand, the rear wall 3*b* is provided with a pair of support sections 7 at both ends of thereof for supporting the other ends of the reels 8 and 9. Each support section 7 has a semi-circular cut-out which is associated with the projection of the support section 5 for journalling the other end of the reel. The cartridge cover 3 includes essentially semi-cylindrical storage sections 3*c* and 3*d* between the support sections 6 and 7 for rotatably receiving the two reels 8 and 9. The storage section 3*c* is associated with the storage section 2*c* to rotatably receive the supply reel 8, while the storage section 3*d* is associated with the storage section 2*d* to rotatably receive the take-up reel 9. The reels 8 and 9 receive a colored ink ribbon 10 comprising a repeating series of differently colored sections, for instance a yellow, a magenta, and a cyanogen section. The cartridge cover 3 also includes an essentially rectangular opening 3*e* between the two storage sections 3*c* and 3*d*.

As seen in FIG. 2. The reels 8 and 9 include flanges 8*a* and 9*a* fixed on and radially extending from one end of each reel respectively, and also include semi-spherical projections 8*b* and 9*b* axially extending from the other end of each reel respectively. The respective projections 8*b* and 9*b* are rotatably supported by the support sections 5 and 7. The two flanges 8*a* and 9*a* have a plurality of radially extending female sections 8*c* and 9*c* respectively, at the sides abutting the inner walls of the support sections 4 serving one end of the reels 8 and 9. As clearly seen in FIG. 3, the respective female sections 8*c* and 9*c* are radially and symmetrically arranged about the axes of the flanges 8*a* and 9*a*. The support sections 4 and 6 respectively include diametrically opposing ribs 4*c* and 6*c* which are capable of engaging with either one pair of diametrically opposing female sections 8*c* and 9*c*. A pair of coil springs 15 are disposed between the inner walls of the two pairs of support sections 5, 7 and the other ends of the reels 8, 9 in such a manner as to bias the two reels 8 and 9 in the right direction (as shown in FIG. 2), thereby causing the ribs 4*c* and 6*c* to normally engage the female sections 8*c* and 9*c*. In this manner, unnecessary rotation of the reels 8 and 9 is prevented by the engagement between the ribs 4*c* and 6*c* and the female sections 8*c* and 9*c*.

However, in such conventional ink ribbon cartridges for printing apparatus, when the cartridge is assembled, the engaging points between the female sections 8*c*, 9*c* of the two flanges 8*a*, 9*a* and the ribs 4*c* and 6*c* must be adjusted so as to tighten the ink ribbon 10, because even a small error such as a one pitch dislocation between the female sections 8*c*, 9*c* and the ribs 4*c*, 6*c* may cause excessive slack in the ink ribbon 10 due to the predetermined pitch between adjacent female sections. Furthermore, in such conventional ribbon cartridges, the engagement between the female sections 8*c* and 9*c* and the ribs 4*c* and 6*c* must be released during printing. For this reason, since the ribbon cartridge must be precisely inserted and positioned in a predetermined position and the above mentioned engagement must be released after insertion of the cartridge, more complicated constructions, such as a releasing mechanism for the above described engagement, are required in the printing apparatus. In addition, coil springs 15 are used in the cartridge assembly; these must be manually installed and mounted in the cartridge body 2 and the cartridge cover 3 during assembly of the body 2 and the cover 3, thereby deteriorating assembly efficiency for the ribbon cartridge. Additionally, parts such as coil springs are expensive.

SUMMARY OF THE INVENTION

It is, therefore, in view of the above disadvantages, an object of the present invention to provide an ink ribbon cartridge which is continuously capable of preventing the ink ribbon from slackening, regardless of whether the printing apparatus is engaged in a printing mode or not.

It is another object of the invention to significantly improve assembly efficiency for constructing ink ribbon cartridges.

In order to accomplish the aforementioned and other objects, an ink ribbon cartridge for printing apparatus comprises supply and take-up reels for winding ink ribbon thereon, each reel including supported portions provided at both ends thereof, a cartridge casing for accommodating the reels therein, the casing including means formed integrally on the inner wall thereof for rotatably supporting the supported portions of the reels, an opening disposed on the casing for exposing a portion of the ink ribbon tightened between the reels, means for continuously applying a constant frictional force on the outer peripheral surface of at least one end of the supported portions of each reel so as to prevent unnecessary rotation of the reels. The applying means further includes a plurality of spring elements formed on at least one end of the casing in such a manner as to apply pressure to diametrically opposing areas on the outer peripheral surface of at least one end of both of the reels at the supported portions thereof. The plurality of spring elements may comprise two pairs of spring members, each pair of spring members being disposed opposite each other, on each side of the casing. Preferably, the spring members are formed integrally with the casing, the spring members and the casing being formed of synthetic resin. However, the spring members may also be formed of metal materials, and respectively attached to the casing by an adhesive agent. The magnitude of the frictional force is determined by the distance between the opposing spring members. The distance is set such that when the frictional force is compared with a force generated by a torque transmitted from a drive shaft provided in the printing apparatus to the reels, the frictional force is desirably at a ratio of 1/10 to 1/5.

Preferably the casing may be formed of two halves. The supporting means may include first support members formed on both sides of each end of one half of the casing for rotatably supporting the supported portions of the reels and may also include second support members formed on both sides of each end of the other half of the casing also for rotatably supporting the supported portions of the reels. The previously mentioned opening for exposing the ink ribbon may be formed substantially in the center of the casing so as to allow insertion of a print head and a platen provided in the printing apparatus. The casing also includes second openings disposed opposing each other on each side in the vicinity of at least one end of the supported portions of each reel, and the spring members may comprise leaf springs protruding from each inner peripheral edge portion of the second openings. A pair of concavities are defined by the inner peripheral edge portions of the second openings and the outer surfaces of the leaf springs. When the cartridge is fully inserted into a cartridge holder provided in the printing apparatus, a projection-like lock member provided on the holder is softly fitted into the concavities, whereby the cartridge is reliably held at a predetermined set position thereof by the lock member.

BEST MODE FOR CARRYING OUT THE INVENTION

The principles of the present invention, applied to ink ribbon cartridges for printing apparatus, are illustrated in FIGS. 4 to 11.

Figure 1:
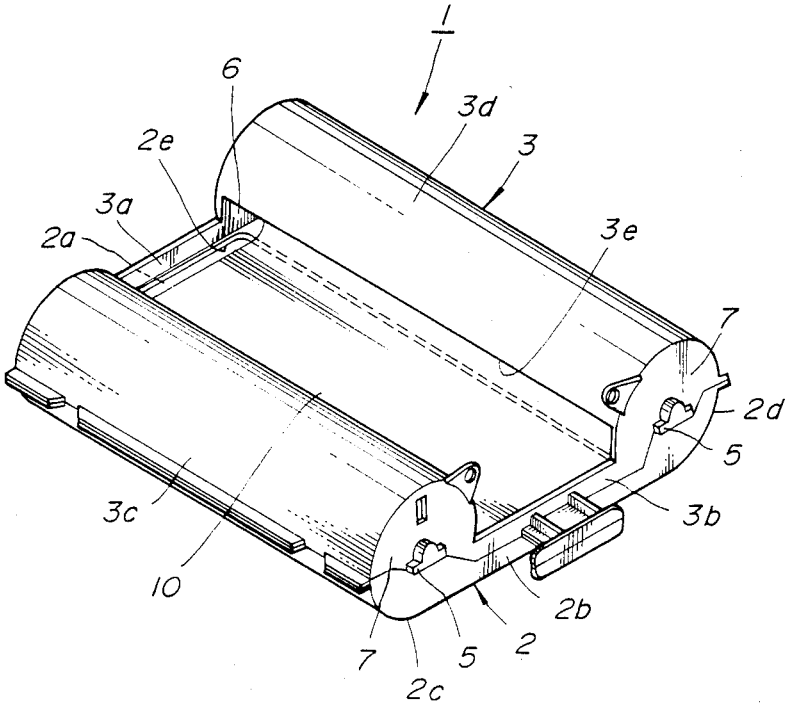
FIG. 1 (PRIOR ART)
FIG. 1 is a perspective view illustrating a conventional ink ribbon cartridge assembly for printing apparatus.
Figure 2:
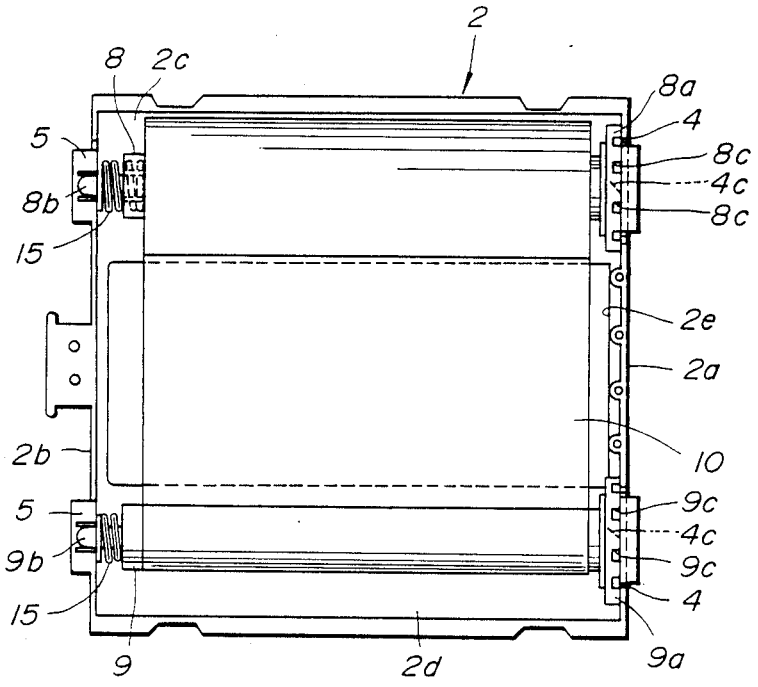
FIG. 2 (PRIOR ART)
FIG. 2 is a plan view illustrating the cartridge body of a conventional cartridge as shown in FIG. 1.
Figure 3:
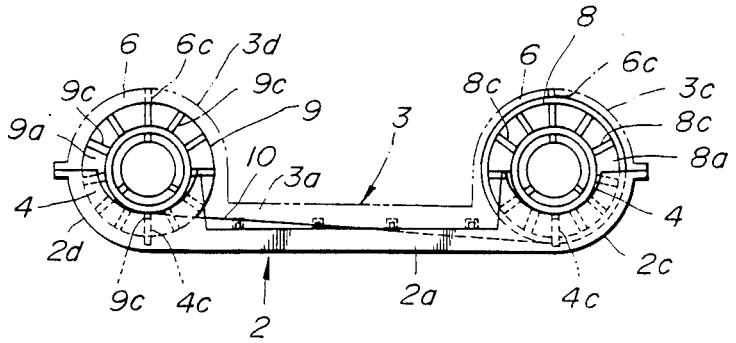
FIG. 3 (PRIOR ART)
FIG. 3 is a back view illustrating the cartridge body of the conventional ribbon cartridge shown in FIGS. 1 and 2.
Figure 4:
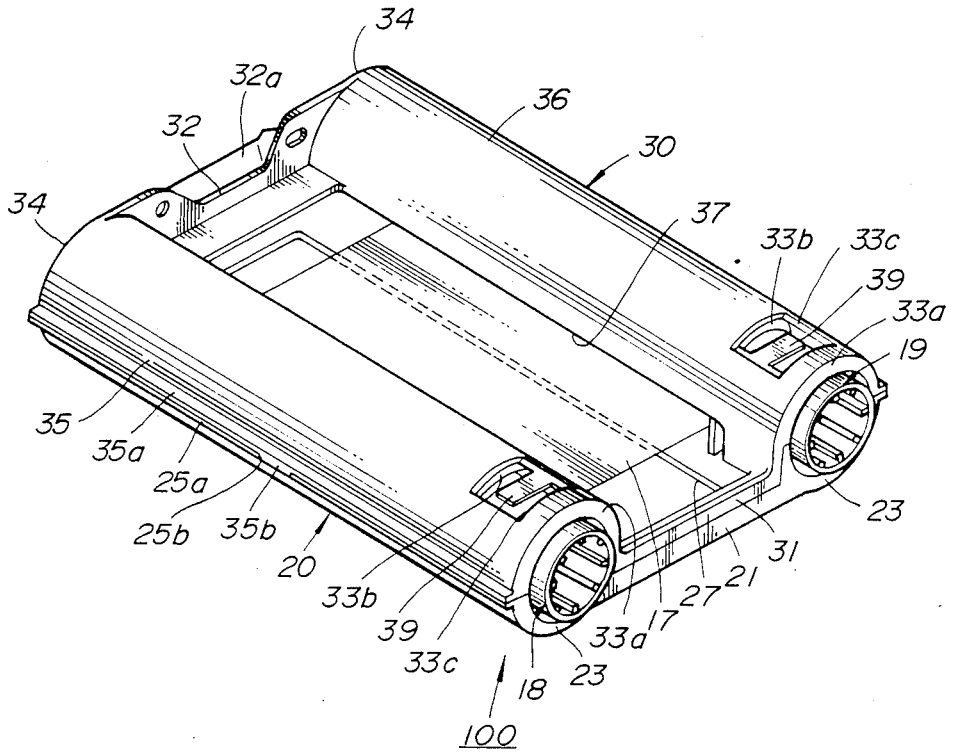
FIG. 4 is a perspective view illustrating a preferred embodiment of an ink ribbon cartridge according to the invention.
Figure 5:
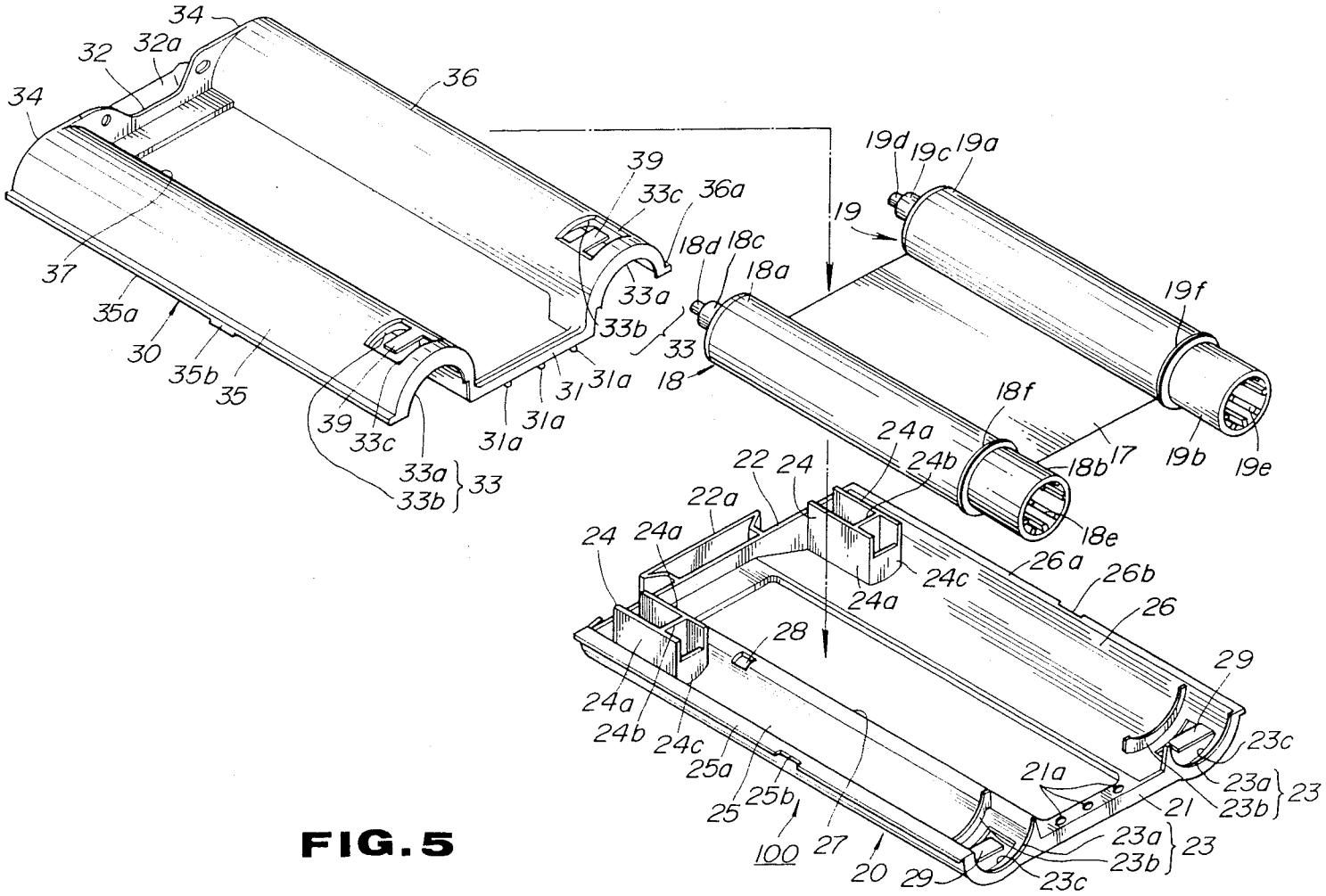
FIG. 5 is an exploded perspective view illustrating the ribbon cartridge shown in FIG. 4 according to the embodiment of the invention.
Figure 6:
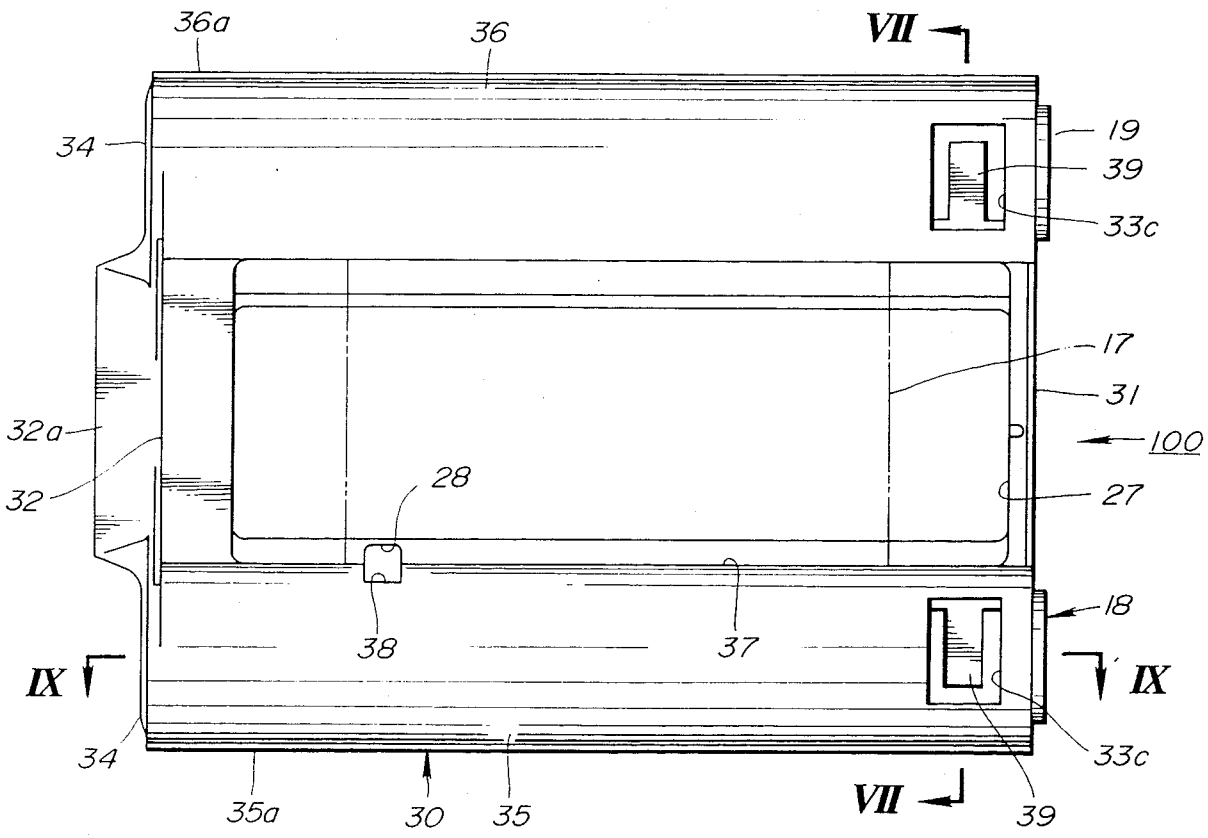
FIG. 6 is a plan view illustrating the ribbon cartridge shown in FIG. 4 according to the invention.
Figure 7:
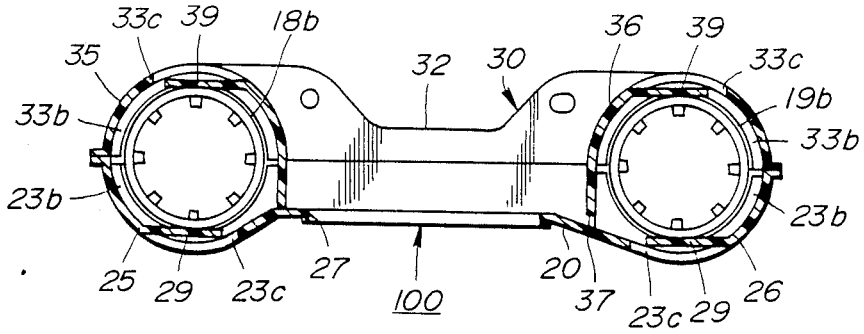
FIG. 7 is a cross-sectional view taken along line VII—VII of FIG. 6.
Figure 8:
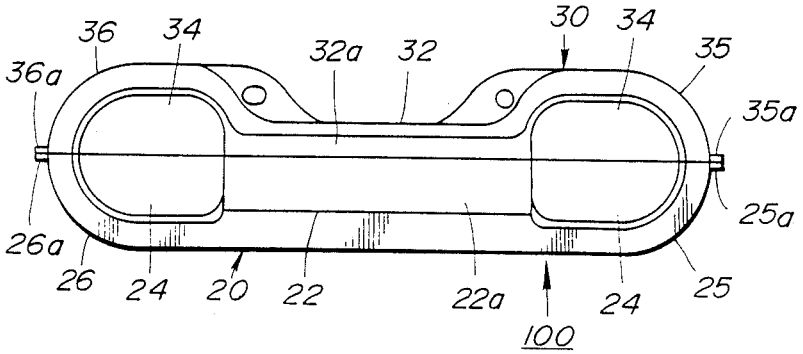
FIG. 8 is a front view illustrating the ribbon cartridge shown in FIG. 4.
Figure 9:
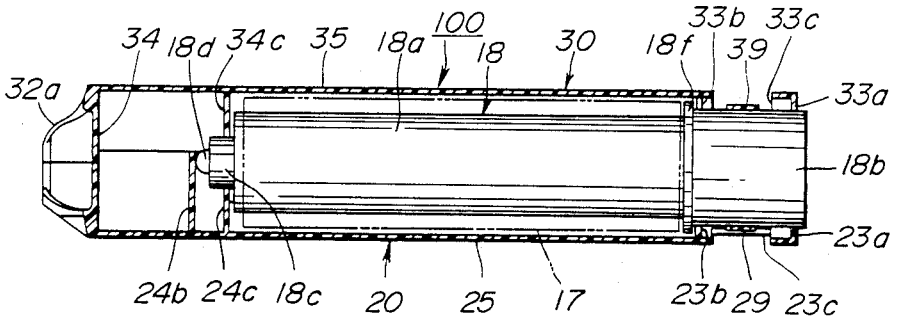
FIG. 9 is a cross-sectional view taken along line IX—IX of FIG. 6.

An ink ribbon cartridge 100 for a printing apparatus (not shown) according to the invention includes a cartridge body 20 (lower half) formed of synthetic resin and a cartridge cover 30 (upper half) formed of synthetic resin to form a cartridge casing. The cartridge body 20 and the cartridge cover 30 are bonded together by ultrasonic welding such that the peripheral edge portion of the cartridge body 20 is connected to the opposing peripheral edge of the cartridge cover 30. As best seen in FIG. 4, a pair of essentially cylindrical supply and take-up reels 18 and 19 are accommodated in an internal space defined between the cartridge body 20 and the cartridge cover 30. As shown in FIGS. 5 and 9, the supply reel 18 is comprised of a cylindrical reel drum **18*a*, a first supported cylindrical portion (reel hub) 18*b* axially extending from one end of the reel drum 18*a*, a second supported cylindrical portion 18*c* axially extending from the other end of the reel drum 18*a*, a semi-spherical projection 18*d* projecting from the second supported portion 18*c*, a plurality of inner teeth 18*e* which are radially and inwardly formed on the inner peripheral surface of the first supported portion 18*b* for engaging with a driving shaft (not shown) provided in the printing apparatus, and a flange 18*f* radially extending from the boundary section between the reel drum 18*a* and the first supported portion 18*b*. Likewise, the take-up reel 19 is also comprised of a cylindrical reel drum 19*a*, a first supported cylindrical portion 19*b* axially extending from one end of the reel drum 19*a*, a second supported cylindrical portion 19*c* axially extending from the other end of the reel drum 19*a*, a semi-spherical projection 19*d* projecting from the second supported portion 19*c*, a plurality of inner teeth 19*e*, and a flange 19*f*. The supply reel 18 is of the same geometry or shape as the take-up reel 19. The first supported portion 18*b* or 19*b* has a slightly larger diameter than that of the reel drum 18*a* or 19*a* for reliably transmitting torque from the drive shaft inserted into the first supported portion. While, the second supported portion 18*c* or 19*c* has a smaller diameter than that of the reel drum 18*a* or 19*a*** to insure smooth rotation of the reel.

The cartridge body 20 has front and rear walls 21 and 22 opposing each other. The front wall 21 has a pair of support sections 23a on both sides thereof. Each support section 23a has a semi-circular cut-out for receiving the outer peripheral surface of the first supported portion of the reel. The cartridge body 20 further includes a pair of intermediate support sections 23b, each being provided spaced inwardly from the support section 23a. As appreciated from FIG. 5, the first supported portions 18b and 19b are rotatably received by the two pairs of support sections 23a and 23b. That is, the support sections 23a and 23b cooperatingly form a pair of support members 23 on each side for supporting the first supported portion of the reels 18 and 19 respectively. In addition, the flanges 18f and 19f are arranged inside of the two intermediate support sections 23b such that the two reels 18 and 19 are set in the cartridge body 20 so as to prevent the two reels 18 and 19 from moving in the direction of the front wall 21.

The rear wall 22 also has a pair of support members 24, one being provided on each side thereof for supporting the second supported portions 18c and 19c. The cartridge body 20 includes substantially semi-cylindrical storage sections 25 and 26 between the support members 23 and 24. The vertically extending support members 24 having a H-shaped cross section are integrally formed of a pair of parallel sections 24a, a cross section 24b, and an inner section 24c having an upper cut-out. The respective ends of the second supported portions 18c and 19c are supported by the upper edges of the two inner sections 24c of the support members 24. The semi-spherical projections 18d and 19d abut the vertical walls of the two cross sections 24b, respectively, in such a manner as to prevent the two reels 18 and 19 from moving in the direction of the rear wall 22. The cartridge body 20 includes an essentially rectangular opening 27 between the two storage sections 25 and 26 so as to insert a print head and a platen, which are applied by the printing apparatus, into the cartridge 100. The cartridge body 20 also includes a small opening 28 between the storage section 25 and the rectangular opening 27 for introducing light emitted by an optical source (not shown) which is provided in the printing apparatus for detecting the color of the ink ribbon 17 wound on the reels 18 and 19. The cartridge body 20 is also equipped with half of a knob section 22a at the center of the rear wall 22.

Since the cartridge cover 30 is similar to the cartridge body 20, it will be hereinafter described in brief.

The cartridge cover 30 has front and rear walls 31 and 32 opposing each other. The front wall 31 has a pair of support sections 33a on each side thereof. Each support section 33a has a semi-circular cut-out for receiving the outer peripheral surface of the first supported portion of the reel. The cartridge body 30 also includes a pair of intermediate support sections 33b, each being provided at a location spaced inwardly from the support section 33a. As is appreciated from FIG. 5, the first supported portions 18b and 19b are rotatably received by the support sections 33a and 33b. In this way, the support sections 33a and 33b cooperatingly form a pair of support members 33 for supporting each first supported portion of the reels 18 and 19. Also, the flanges 18f and 19f are arranged inside of the two intermediate support sections 33b in a state wherein the two reels 18 and 19 are set in the cartridge cover 30, so as to prevent the two reels 18 and 19 from moving in the direction of the front wall 31.

On the other hand, the rear wall 32 has a pair of support members 34 at both sides thereof for supporting the second supported portions 18c and 19c. The cartridge cover 30 includes substantially semi-cylindrical storage sections 35 and 36 between the support members 33 and 34. As shown in FIG. 9, each vertically extending support member 34 is employed with an inner section 34c opposing the inner section 24c of the support member 24. The respective upper sections of the second supported portions 18c and 19c are supported by the lower edges of the two inner sections 34c of the support member 34. The cartridge cover 30 includes an essentially rectangular opening 37 between the two storage sections 35 and 36. The cartridge cover 30 also includes a small opening 38 for transmitting light emitted from the previously described optical source (not shown) through a portion of ink ribbon tightened between the two reels 18 and 19 to an optical sensor (not shown) which is provided in the printing apparatus for detecting the color of the ink ribbon 17. This colored ink ribbon 17 is generally made of a continuously repeating series, each series being divided into three coloured segments, each segment being either yellow, red (magenta), or blue (cyanogen). As is generally known, in a new ink ribbon cartridge, almost all the ink ribbon 17 is wound on the reel drum 18a of the supply reel 18. The colored ink ribbon traditionally includes black lines (not shown) at predetermined positions for automatically scanning the beginning of each coloured segment. The cartridge cover 30 further includes half of a knob section 32a being associated with the knob half section 22a to form a knob applied for taking the ribbon cartridge 100 out of the printing apparatus.

The cartridge body 20 includes two side flanges 25a and 26a horizontally and outwardly extending from the upper edges of the storage sections 25 and 26, while the cartridge cover 30 includes two side flanges 35a and 36a horizontally and outwardly extending from the lower edges of the storage sections 35 and 36. When the cartridge body 20 and the cartridge cover 30 are assembled, the upper edges of the front and rear walls 21, 22 and the lower edges of the front and rear walls 31, 32, the upper surfaces of both side flanges 25a, 26a and the lower surfaces of both side flanges 35a, 36a, and the upper edge of the knob half section 22a and the lower edge of the knob half section 32a mate with each other in such a manner that the two reels 18 and 19 having the ink ribbon 17 wound thereon are precisely set in the storage sections 25, 35 and 26, 36. In order to provide a precise positioning between the cartridge body 20 and the cartridge cover 30, the cartridge body 20 has a plurality of locating holes 21a and locating notches 25b and 26b, while the cartridge cover 30 has a plurality of projections 31a fitting into the locating holes 21a and projections 35b and 36b fitting into the locating notches 25b and 26b. The cartridge cover 30 abuts the cartridge body 20 and finally portions of the abutting sections are welded together by ultrasonic welding to provide a completed ink ribbon cartridge assembly.

As shown in FIG. 5, the ink ribbon cartridge 100 of the preferred embodiment according to the invention, comprises a pair of lower leaf spring members 29 which are disposed between the two support sections 23a and 23b, and a pair of upper leaf spring members 39 which are disposed between the two support sections 33a and 33b. The two leaf spring members 29 protrude substantially horizontally from the outermost edges of the pair of lower rectangular openings 23c, each being formed on the curved surface between the two parallel support sections 23a and 23b, on an essentially horizontal plane parallel to the central edge section of the front wall 21. Similarly, the two leaf spring members 39 protrude substantially horizontally from the innermost edges of the pair of upper openings 33*c*, each being formed on the curved surface between the two parallel support sections 33*a* and 33*b*, on an essentially horizontal plane parallel to the central section of the front wall 31.

In a condition wherein the cartridge assembly does not include the two reels 18 and 19, the distance between the upper and lower leaf spring members 39 and 29 are set to be slightly smaller than the outer diameter of the first supported portion 18*b* or 19*b*. Therefore, when the cartridge body 20, the cartridge cover 30, and the two reels 18 and 19 are actually assembled, the leaf spring members 29 and 39 continuously apply pressure to diametrically opposing areas on the outer peripheral surfaces of the first supported portions 18*b* and 19*b*, respectively, thereby normally causing frictional force between the upper and lower leaf spring members 29, 39 and the outer peripheral surfaces of the first supported portions 18*b* and 19*b*. This frictional force serves as braking force for preventing unnecessary rotation of the reels 18 and 19. The magnitude of the frictional force is determined by the previously described distance between the upper and lower leaf spring members 39 and 29. Since, the above mentioned frictional force is continuously applied on the outer peripheral surfaces of the first supported portions 18*b* and 19*b* whether printing is in progress or not, this distance must be optimally selected in such a manner that the frictional force is set to a relatively small value in consideration of the force generated by torque transmitted from the drive shaft (not shown) to the reels 18 and 19. For instance, the distance may be set such that the frictional force is equal to the above mentioned force of 1/10 to 1/5. As a result, fluctuations in torque transmitted from the driving shaft of the printing apparatus are avoided, thereby causing smooth rotation of the reels 18 and 19 during printing. In other words, during printing, clear printing will be performed regardless of the frictional force generated by the leaf spring members 29 and 39.

As best seen in FIG. 5, since the ink ribbon cartridge assembly 100 is comprised of the ink ribbon 17, the supply and take-up reels 18 and 19, the cartridge body 20, and the cartridge cover 30, this construction is considerably simpler than prior art constructions. Furthermore, the cartridge 100 does not require coil springs as used in conventional ribbon cartridges. In addition, since rotation of the two reels 18 and 19 accommodated in the cartridge 100 is continuously and optimally restricted by pressure applied from the leaf spring members 29 and 39 to the outer peripheral surfaces of the two first supported portions 18*b* and 19*b*, slack in the ink ribbon 17 may be continuously avoided.

Figure 10:
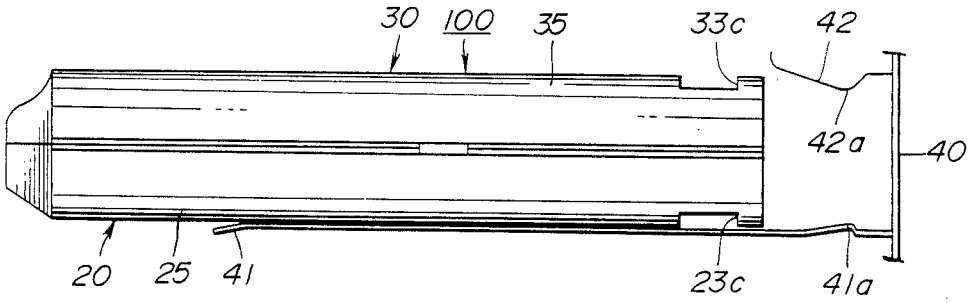
FIG. 10 is a side view illustrating the positional relationship between the ribbon cartridge and the printing apparatus at a state in which the ribbon cartridge is part way inserted into the printing apparatus.
Figure 11:
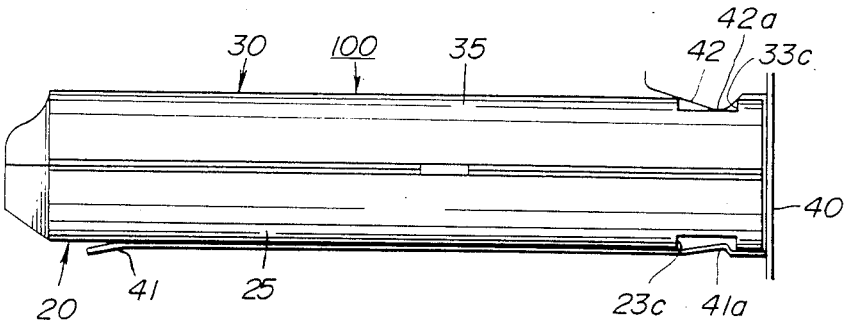
FIG. 11 is a side view illustrating the positional relationship between the ribbon cartridge and the printing apparatus at a state in which the ribbon cartridge is fully inserted into the printing apparatus.

Referring now to FIGS. 10 and 11, the reference numeral 40 denotes a cartridge holder provided in the printing apparatus for holding the cartridge 100. The cartridge holder 40 includes a bottom plate 41 having a projection 41*a* and a leaf spring member 42 having a projection 42*a*. FIG. 10 shows the positional relationship between the cartridge 100 and the cartridge holder 40 before the cartridge 100 is inserted into the cartridge holder 40. FIG. 11 shows the positional relationship between the cartridge 100 and the cartridge holder 40 after the cartridge 100 is fully inserted into the cartridge holder 40. As clearly seen in FIG. 11, the projections 41*a* and 42*a* are softly fitted into two pairs of concavities defined by the leaf spring members 29 and 39 and the openings 23*c* and 33*c*. In this manner, during printing, the cartridge 100 is reliably held at its predetermined set position by the cartridge holder 40.

Although in the above described preferred embodiment, one end of the reels 18 and 19 is continuously pushed by upper and lower leaf spring members 29 and 39, both ends of each reel may be continuously pushed by upper and lower leaf spring members in a variation of the embodiment.

In the preferred embodiment of the invention, the leaf spring members 29 are integrally formed with the cartridge body 20 and also the leaf spring members 39 are integrally formed with the cartridge cover 30. However, the leaf spring members 29 and 39, which can be made of metal materials or of synthetic resin as with the other parts of the cartridge, may be adhered to the cartridge body and the cartridge cover by an adhesive agent.

While the foregoing is a description of the best mode for carrying out the invention, it will be understood that the invention is not limited to the particular embodiments shown and described herein, but may include variations and modifications without departing from the scope or spirit of this invention as described by the following claims.

What is claimed is:

1. An ink ribbon cartridge for a printing apparatus comprising:

supply and take-up reels for winding an ink ribbon thereon, each of said reels including supported portions provided at both ends thereof;

a cartridge casing formed from at least two mating portions for accommodating said reels therein, said casing including means formed integrally on the inner wall thereof for rotatably supporting said supported portions of said reels;

an opening disposed on said casing for exposing a portion of the ink ribbon tightened between said reels;

means for continuously applying a constant frictional force to the outer diametrical peripheral surface of at least one end of both of said reels at the supported portions thereof so as to prevent unnecessary rotation of said reels; and said applying means including a plurality of spring elements formed on at least one end of said casing in such a manner as to apply pressure to diametrically opposing areas on the outer peripheral surface of at least one end of both of said reels at the supported portions thereof.

2. The ink ribbon cartridge as set forth in claim 1, wherein said plurality of spring elements comprise two pairs of spring members, each pair of spring members being disposed opposite each other, on each side of said casing.

3. The ink ribbon cartridge as set forth in claim 2, wherein said spring members are formed integrally with said casing, said spring members and said casing being formed of synthetic resin.

4. The ink ribbon cartridge as set forth in claim 2, wherein said spring members are formed of metal materials and respectively attached to said casing by an adhesive agent.

5. The ink ribbon cartridge as set forth in claim 2, wherein the magnitude of said frictional force is determined by the distance between said opposing spring members, the distance being set such that when said frictional force is compared with a force generated by torque transmitted from a drive shaft provided in said printing apparatus to said reels, wherein said frictional force is smaller than said force generated by said torque, and wherein said frictional force is at a ratio from 1/10 to 1/5 on said force generated by said torque.

6. The ink ribbon cartridge as set forth in claim 1, wherein said supporting means includes first support members formed on both sides of each end of one mating portion of said casing for rotatably supporting said supported portions of said reels and includes second support members formed on both sides of each end of the other mating portion of said casing for rotatably supporting said supported portions of said reels.

7. The ink ribbon cartridge as set forth in claim 6, wherein said opening is formed substantially in the center of said casing so as to insert a print head and a platen provided in said printing apparatus.

8. The ink ribbon cartridge as set forth in claim 7, wherein said casing includes second openings disposed opposing each other on each side in the vicinity of at least one end of the supported portions of each of said reels, and said spring members comprise leaf springs protruding from each inner peripheral edge portion of said second openings.

9. An ink ribbon cartridge for a printing apparatus, comprising:

supply and take-up reels for winding an ink ribbon thereon, each of said reels including supported portions provided at both ends thereof;

a cartridge casing formed of two halves for accommodating said reels therein, said casing including means formed integrally on the inner wall thereof for rotatably supporting said supported portions of said reels, said supporting means including first support members formed both on sides of each end of one half of said casing for rotatably supporting said supported portions of said reels and includes second support members formed on both sides of each end of the other half of said casing for rotatably supporting said supported portions of said reels;

said casing including second openings disposed opposing each other on each side in the vicinity of at least one end of the supported portions of each of said reels, and said spring members comprise leaf springs protruding from each inner peripheral edge portion of said second openings;

an opening disposed on said casing for exposing a portion of the ink ribbon tightened between said reels wherein said opening is formed substantially in the center of said casing so as to insert a print head and a platen provided in said printing apparatus;

means for continuously applying a constant frictional force to the outer peripheral surface of at least one end of both of said reels at the supported portions thereof so as to prevent unnecessary rotation of said reels; and said applying means including a plurality of spring elements formed on at least one end of said casing in such a manner as to apply pressure to diametrically opposing areas on the outer peripheral surface of at least one end of both of said reels at the supported portions thereof;

wherein a pair of concavities are defined by the inner peripheral edge portions of said second openings and the outer surfaces of said leaf springs, so that when said cartridge is fully inserted into a cartridge holder provided in said printing apparatus, a projection like lock member provided on the holder is softly fitted into said pair of concavities, whereby said cartridge is reliably held at a predetermined set position thereof by the lock member.

10. An ink ribbon cartridge for a printing apparatus, comprising:

supply and take-up reels for winding an ink ribbon thereon, each of said reels including supported portions provided at both ends thereof;

a cartridge casing for accommodating said reels therein, said casing including means formed integrally on the inner wall of said casing for rotatably supporting said supported portions of said reels;

an opening disposed on said casing for exposing a portion of the ink ribbon tightened between said reels; and spring means for continuously applying a constant frictional force having a magnitude less than a rotational torque provided to said reels from a drive shaft in said apparatus, said force being applied to an outer diametrical peripheral surface of at least one end of both of said reels at the supported portions thereof for preventing unnecessary rotation of said reels, said spring means including at least a pair of spring elements formed on at least one end of said casing and being sized and located to apply pressure to said diametrical peripheral surface at opposing portions of at least one end of both of said reels at the supporting portions thereof.

11. The cartridge as set forth in claim 10 wherein said spring elements are leaf springs.

12. The cartridge as set forth in claim 10 wherein a ratio of said frictional force to said drive torque is on the order of 1/10 to 1/5.

13. The cartridge as set forth in claim 10 wherein said spring means includes a pair of lower leaf spring members disposed between the supported sections and a pair of upper leaf spring members disposed between the other supported sections.

14. The cartridge as set forth in claim 13 wherein said lower leaf spring members protrude substantially horizontally from an outermost edge of a pair of lower rectangular openings in said casing, each being formed on a curved surface between the support sections on an essentially horizontal plane parallel to the central edge section of a front wall of the casing.

* * * * *